United States Patent [19]

Hashizume

[11] Patent Number: 4,777,805

[45] Date of Patent: Oct. 18, 1988

[54] HEAT PUMP SYSTEM

[75] Inventor: Kenichi Hashizume, Tokyo, Japan

[73] Assignee: Kabushiki Kaisha Toshiba, Kawasaki, Japan

[21] Appl. No.: 57,701

[22] Filed: Jun. 1, 1987

Related U.S. Application Data

[62] Division of Ser. No. 776,703, Sep. 16, 1985, abandoned.

[30] Foreign Application Priority Data

| | | | |
|---|---|---|---|
| Sep. 19, 1984 | [JP] | Japan | 59-194848 |
| Sep. 19, 1984 | [JP] | Japan | 59-194847 |
| Dec. 10, 1984 | [JP] | Japan | 59-259210 |

[51] Int. Cl.[4] ..... F25B 7/00; F25B 1/10

[52] U.S. Cl. ..... 62/114; 62/238.6; 62/335; 62/510

[58] Field of Search ..... 62/510, 335, 238.6, 62/114, 112

[56] References Cited

U.S. PATENT DOCUMENTS

| | | | |
|---|---|---|---|
| 1,808,494 | 6/1931 | Carney et al. | 62/335 |
| 2,008,407 | 7/1935 | Stoever | 62/510 |
| 2,215,046 | 9/1940 | Kramhoff | 62/335 |
| 4,498,999 | 2/1985 | Ramet et al. | 62/114 |

FOREIGN PATENT DOCUMENTS

| | | | |
|---|---|---|---|
| 211160 | 7/1984 | Fed. Rep. of Germany | 62/510 |
| 918726 | 4/1982 | U.S.S.R. | 62/335 |

*Primary Examiner*—Albert W. Davis, Jr.

*Attorney, Agent, or Firm*—Foley & Lardner, Schwartz, Jeffery, Schwaab, Mack, Blumenthal & Evans

[57] ABSTRACT

A process and apparatus for a multistage heat pump system. The system includes a compressor which compreses a working medium, a condenser which condenses the working medium, and an evaporator which evaporates the working medium, and has a construction in which at least either one of the condenser or the evaporator includes a plurality of heat exchange chambers, at least either one of the delivery side or the suction side of the compressor including a plurality of ports that are on different pressure levels, the plurality of heat exchange chambers and the plurality of ports being connected to each other. A cascade system is also disclosed, in which two working mediums are used, one for a high-temperature cycle and one for a low-temperature cycle. The cascade heat exchanger can be single or multistage. The above construction allows the temperature of the working medium to vary along with the temperature variations of a heat source fluid. Because of this, it becomes possible to restrain irreversible energy losses, and achieve a marked improvement in performance.

3 Claims, 10 Drawing Sheets

HEAT PUMP SYSTEM

This application is a division of application Ser. No. 776,703, filed Sept. 16, 1985, now abandoned.

BACKGROUND OF THE INVENTION

1. Field of the Invention

The present invention relates generally to heat pumps, and more particularly to a heat pump system which diminishes the irreversible energy losses that occur during heat exchange.

2. Description of the Prior Art

A heat pump system which produces a high-temperature source fluid, such as hot water, by making use of a low-temperature source fluid, such as industrial waste water, has heretofore been known. In particular, a heat pump system of the compression type in which the compressor is driven by means of an electric motor or a heat engine is now in wide use because of the availability of heat energy that reaches even several times the power input.

However, when the low-temperature source fluid or the high-temperature source fluid is a single-phase fluid such as water without phase change, performance of the system has been limited. Explaining the situation based on FIG. 1 which describes temperature variations during heat exchange between source fluid and a single-component working medium for a prior art system, the abscissa shows the amount of heat exchanged and the ordinate shows the temperature. In the figure, the segment $T_e$ represents the temperature during the evaporation process of the working medium, the segment $T_c$ the temperature in the condensation process of the working medium, the segment $T_A$ the temperature variation of the high-temperature source fluid, and the segment $T_B$ the temperature variation of the low-temperature source fluid, respectively. Like in the above, a single-component working medium possesses a fixed boiling point so that its temperature remains unchanged during its process of evaporation or condensation. In contrast, the temperature of a single-phase source fluid varies along the direction of its flow during the process of heat exchange. Because of this, the hatched portions of FIG. 1 remain as the irreversible energy losses during the heat exchange, giving a limitation on the effort for improving the performance of the system.

To cope with this situation, use of a non-azeotropic mixture as the working medium has been proposed. With a non-azeotropic mixture which is obtained by mixing single-component media at a fixed ratio, it becomes possible to vary the temperature, both in the processes of evaporation and condensation, in the manner as shown by the segments $T_d$ and $T_f$, by making an advantageous use of the difference between the boiling points of the two media. Then, it becomes possible to reduce the temperature differences between the working medium and the source fluids during heat exchange, suppressing the irreversible energy losses.

However, the use of such a non-azeotropic mixture has not been put into a wide-spread practical use for reasons such as the technical difficulty in restoring the mixture composition to the initially set composition when the mixture leaks from the system.

In addition, as a heat pump system of other kind, there has been known a cascaded heat pump system which is obtained by coupling a low-temperature cycle to a high-temperature cycle with a cascading heat exchange. The cascaded heat pump system permits the range of temperature rise to be set at a large value. Thus, for example, it is possible to generate hot water of over 150° C., or the like, by the use of 30° C. to 60° C. industrial waste water for the low-temperature source fluid. However, as in the heat pump system described above, the cascaded heat pump system suffers from a certain limitation in the effort to improve the performance in the case when a single-phase fluid like water without phase change is used for the low or high-temperature source fluid.

This may be explained based on FIG. 2. In this figure, the temperature variations during the heat exchange between the source fluids and the working media are shown for the case when single-component working media are used for both the high-temperature cycle and the low-temperature cycle, where the abscissa is the amount of heat exchanged and the ordinate is the temperature. The segment $T_e$ represents the temperature of the working medium during the evaporation process in the low-temperature cycle; segment $T_c$ represents the temperature during the condensation process in the high-temperature cycle; segment $T_B$ represents the temperature variation of the low temperature source fluid; segment $T_A$ represents the temperature variation of the high-temperature source fluid; segment $T_p$ represents the temperature of the working medium on the low-temperature cycle side in the cascading heat exchanger, and segment $T_q$ represents the temperature of the working medium on the high-temperature cycle side in the cascading heat exchanger. As seen in the figure, in contrast to the constancy of temperature during the process of evaporation or condensation of a single-component working medium which possesses a fixed boiling point, the temperatures of single-phase source fluids during the heat exchange vary along the flow of the fluid. Because of this, the hatched portions of FIG. 2 become irreversible energy losses during the heat exchange, giving a limitation on the effort for improving the performance of the system.

It has also been proposed to utilize a non-azeotropic mixture as the working medium in a cascaded heat pump system. A non-azeotropic mixture obtained by mixing single-component media at a fixed ratio is aimed at introducing temperature variations in either the evaporation process or the condensation process by means of the difference in the boiling points of the two media. Therefore, by utilizing a non-azeotropic mixture as the working medium and by arranging for it to flow countercurrent-wise with respect to the source fluid to carry out heat exchange, the temperature difference during heat exchange between the working medium and the source fluid can be made small as represented by the segment $T_d$ with respect to the segment $T_B$, making it possible to reduce the irreversible energy loss.

However, refrigerants such as R11 or R114, that can be chosen as components of a non-azeotropic mixture may only be suitable up to about 120° C. of high-temperature output due to reasons of thermal stability and the like. Because of this, use of a non-azeotropic mixture in the cascaded heat pump system is limited to the low-temperature cycle alone, necessitating the use of a single-component medium for the high-temperature side.

Moreover, in a cascaded heat pump system with high-temperature output, water vapor is sometimes generated in the high-temperature cycle condenser. When water vapor is generated in this way, the temperature of the high-temperature source fluid, instead of changing in the direction of the fluid flow, behaves as shown by the segment $T_R$ due to the evaporation that accompanies the vapor generation in the condenser. Owing to this, even when the temperature of the working medium does not change in the condensation process, the temperature difference between the working medium and the high-temperature source fluid will not widen, and hence, the irreversible energy loss during heat exchange will not increase. Accordingly, there will be found no inevitability in such a case for using a non-azeotropic mixture on the high-temperature side.

Furthermore, when a non-azeotropic mixture is used for the low-temperature cycle and a single-component medium is used for the high-temperature cycle in a cascading heat exchanger, the single-component medium stays in its evaporation process at a constant temperature as represented by the segment $T_q$, while the non-azeotropic mixture during its condensation process decreases its temperature as shown by the segment $T_f$. For this reason, the temperature difference between the non-azeotropic mixture and the single-component medium, during the heat exchange process in the cascading heat exchanger, widens, thereby increasing the irreversible energy loss in the process and thereby resulting in a problem that the special features of the non-azeotropic mixture fail to be fully utilized.

SUMMARY OF THE INVENTION

It is accordingly an object of the present invention to provide a heat pump system which is capable of diminishing the irreversible energy losses that occur during heat exchange between a working medium and source fluids.

It is another object of the present invention to provide a heat pump system which is capable of markedly improved performance.

It is yet another object of the present invention to provide a heat pump system which is capable of changing the temperature variations of a working medium so as to be in parallel with the temperature variations of a source fluid, at least in either one of the evaporation process and the condensation process, during heat exchange.

It is still another object of the present invention to provide a cascaded heat pump system which is capable of taking full advantage of the special features of a non-azeotropic mixture even when the non-azeotropic mixture is used for the low-temperature cycle and a single-component medium is used for the high-temperature cycle.

It is yet another object of the present invention to provide a cascaded heat pump system which is capable of restraining the widening of the temperature difference between a single-component medium for the high-temperature cycle and a non-azeotropic mixture for the low-temperature cycle.

It is still another object of the present invention to provide a heat pump system which is capable of separately applying a working medium that is on various pressure levels to a plurality of condensation chambers.

These objects and others are achieved by a multistage heat pump system comprising a first compressor for compresing a first working medium, the compressor including at least on its delivery side a plurality of ports which are on different pressure levels; condensation means for condensing the first working medium by heat exchange with a high-temperature source fluid, the condensation means including a plurality of condensation chambers, each chamber receiving working medium from a separate delivery port of the compressor, the high-temperature source fluid flowing through the plurality of condensation chambers in series fashion and being heated thereby; a second compressor for compressing a second working medium; evaporation means for evaporating the second working medium by heat exchange with a low-temperature source fluid; and cascade heat exchange means for exchanging heat between the first working medium from the condensation means and the second working fluid from the second compressor.

The objects of the invention are also achieved by utilizing a single working medium together with a plurality of condensation chambers, the working medium being evaporated after condensation in a single or multistage evaporator. If a multistage evaporator is used, the working fluid can be returned to the compressor via a plurality of vapor suction ports. The working medium can be fed to the condenser in parallel or series fashion. In the latter case, working medium passes successively through the condensation chambers and is compressed in a separate stage of the compressor prior to entering each stage.

The objects of the invention are further achieved by providing a cascade heat exchanger in a heat pump system in which the evaporation means is multistage, while the condensation means is single stage. The evaporation means is provided with a plurality of evaporation chambers which receive a working fluid in parallel fashion, the working fluid being sucked into a compressor through a plurality of vapor suction ports.

The objects of the invention are still further achieved by providing a cascade heat exchanger having a plurality of heat exchange chambers. The chambers receive a first working medium either in parallel or in series, and receive a second working medium in series. Optionally, the cascade heat exchanger can include means for vapor-liquid separation.

These and other objects, features and advantages of the present invention will be more apparent from the following description of the preferred embodiments, taken in conjunction with the accompanying drawings.

DETAILED DESCRIPTION OF THE PREFERRED EMBODIMENTS

Figure 1:
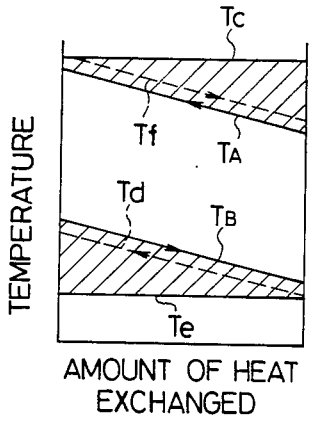
FIG. 1 is an explanatory diagram of operation for illustrating the temperature variations during the heat exchange in a prior art heat pump system.
Figure 2:
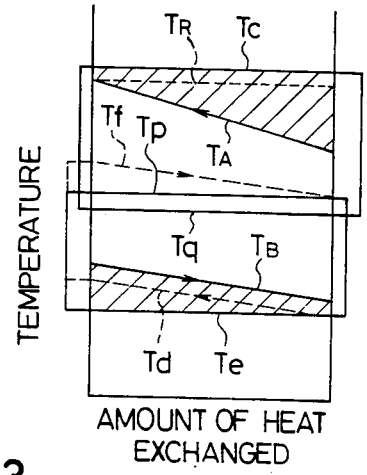
FIG. 2 is an explanatory diagram of operation for illustrating the temperature variations during the heat exchange in a prior art cascaded heat pump system.

A feature of the present invention is that, in a heat pump system which is equipped with a compressor for compressing a working medium sealed in the interior, a condenser for condensing the working medium, and an evaporator for evaporating the working medium, there is given a construction in which at least either one of the condenser and the evaporator includes a plurality of heat exchange chambers, at least one on the delivery side and the suction side of the compressor including a plurality of ports that are on different pressure levels, the plurality of heat exchange chambers and the plurality of ports being connected to each other.

Another feature of the present invention is that, in a heat pump system comprising a high-temperature cycle equipped with a high-temperature compressor for compressing a working medium sealed in the interior and a condenser for condensing the working medium, a low-temperature cycle equipped with a low-temperature compressor for compressing a working medium sealed in its interior and an evaporator for evaporating the working medium, and a cascading heat exchanger for carrying out heat exchange between the high-temperature cycle and the low-temperature cycle by coupling the two cycles, there is given a construction in which at least either one of the condenser and the evaporator includes a plurality of heat exchange chambers, at least one of the delivery side of the high-temperature compressor and the suction side of the low-temperature compressor including a plurality of ports that are on different pressure levels, the plurality of heat exchange chambers and the plurality of ports being connected to each other.

Another feature of the present invention is that, in a cascaded heat pump system comprising a high-temperature cycle equipped with a compressor for compressing a single-component medium sealed in the interior and a condenser for condensing the single-component medium, a low-temperature cycle having a nonazeotropic mixture sealed in it, and a cascading heat exchanger for carrying out heat exchange between the high-temperature cycle and the low-temperature cycle by coupling the two cycles, there is given a construction in which the cascading heat exchanger includes a plurality of heat exchange chambers, the suction side of the compressor of the high-temperature cycle including a plurality of suction ports that are on different pressure levels, and the plurality of heat exchange chambers and the plurality of suction ports being connected to each other.

Still another feature of the present invention is that, in a cascaded heat pump system, there is given a construction in which the cascading heat exchange includes a plurality of heat exchange chambers, the condenser includes a plurality of condensation chambers, the delivery side and the suction side of the compressor of the high-temperature cycle including a plurality of delivery ports and suction ports that are on different pressure levels, and the plurality of delivery ports and suction ports being connected to the plurality of condensation chambers and heat exchange chambers.

Another feature of the present invention includes a construction in which the compressor is divided into a plurality of stages, the condenser is divided into a plurality of condensation chambers, the first stage compressor sucking the vapor of the working medium from the evaporator and letting it flow in the first condensation chamber after compressing it, the second stage compressor compressing the vapor in the first condensation chamber and letting it flow in the second condensation chamber, the third and the following stages carrying out similar operations, and the last stage (n-th stage) compressor compressing the vapor in the (n−1)th condensation chamber and letting it flow in the last (n-th) condensation chamber.

Figure 3:
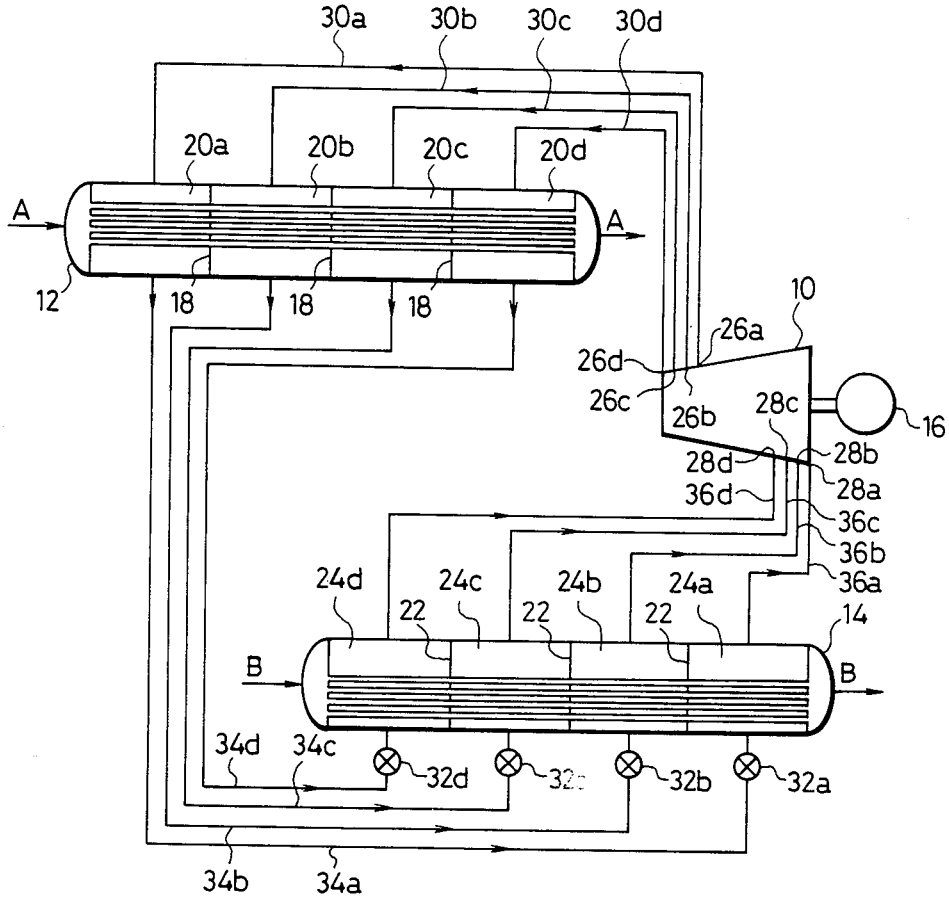
FIG. 3 is a block diagram of a heat pump system embodying the present invention.

Referring to FIG. 3, there is shown a heat pump system embodying the present invention which includes a compressor 10, a condenser 12, and an evaporator 14. The compressor 10 which is arranged to be driven by a motor 16 compresses a single-component working medium sealed in the interior of the cycle, and it is arranged that the condenser 12 condenses the working medium and the evaporator 14 evaporates the working medium.

The interior of the condenser 12 is divided by a plurality (three in FIG. 3) of partitioning plates 18 and includes a first condensation chamber **20*a*, a second condensation chamber 20*b*, a third condensation chamber 20*c*, and a fourth condensation chamber 20*d*, as a plurality (four in FIG. 3) of heat exchange chambers. The first condensation chamber 20*a* through the fourth condensation chamber 20*d* are set in the flow direction of the high-temperature source fluid (A). The interior of the evaporator 14 is divided, similar to the condenser 12, by a plurality (three in FIG. 3) of partitioning plates 22, and includes a plurality (four in FIG. 3) of heat exchange chambers, namely, a first evaporation chamber 24*a*, a second evaporation chamber 24*b*, a third evaporation chamber 24*c*, and a fourth evaporation chamber 24*d***.

Similarly, the delivery side of the compressor 10 includes a plurality (four in FIG. 3) of ports, namely, a first delivery port **26*a*, a second delivery port 26*b*, a third delivery port 26*c*, and a fourth delivery port 26*d***.

Each of the first delivery port 26a through the fourth delivery port 26d has a different pressure level, constructed so as to have successively higher pressure levels from the first delivery port 26a toward the fourth delivery port 26d so that the fourth delivery port 26d has the highest pressure level.

On the suction side of the compressor 10 there are furthermore set a plurality (four in FIG. 3) of ports, namely, a first suction port 28a, a second suction port 28b, a third suction port 28c, and a fourth suction port 28d. The first suction port 28a through the fourth suction port 28d are constructed so as to be on different pressure levels respectively, with the first suction port 28a being at the lowest pressure level and the pressure being increased successively toward the fourth suction port 28d. The first delivery port 26a is connected via the first vapor delivery piping 30a to the first condensation chamber 20a, the second delivery port 26b is connected via the second vapor delivery piping 30b to the second condensation chamber 20b, the third delivery port 26c is connected via the third vapor delivery piping 30c to the third condensation chamber 20c, and the fourth delivery port 26d is connected via the fourth vapor delivery piping 30d to the fourth condensation chamber 20d, respectively. In addition, the first condensation chamber 20a is connected, via a first liquid piping 34a in which is inserted a first expansion device 32a, to the first evaporation chamber 24a, the second condensation chamber 20b is connected, via a second liquid piping 34b in which is inserted a second expansion device 32b, to the second evaporation chamber 24b, the third condensation chamber 20c is connected, via a third liquid piping 34c in which is inserted a third expansion device 32c, to the third evaporation chamber 24c, and the fourth condensation chamber 20d is connected, via a fourth liquid piping 34d in which is inserted a fourth expansion device 32d, to the fourth evaporation chamber 24d, respectively.

The first evaporation chamber 24a is connected via a first vapor suction piping 36a to the first suction port 28a, the second evaporation chamber 24b is connected via a second vapor suction piping 36b to the second suction port 28b, the third evaporation chamber 24c is connected via a third vapor suction piping 36c to the third suction port 28c, and the fourth evaporation chamber 24d is connected via a fourth vapor suction piping 36d to the fourth suction port 28d, respectively.

Next, the operation of the embodiment will be described. When the compressor 10 is driven by the motor 16, the working medium is compressed, and the working medium that is on different pressure levels is delivered from the first delivery port 26a through the fourth delivery port 26d, respectively. Here, the working medium is delivered with its pressure level which is lowest at the first delivery port 26a and highest at the fourth delivery port 26d. The working medium delivered from the first delivery port 26a flows via the first vapor delivery piping 30a into the first condensation chamber 20a where it is liquified by condensation, and then flows into the first evaporation chamber 24a after passing through the first liquid piping 34a and being expanded in the first expansion device 32a. The working medium flowing into the first evaporation chamber 24a is evaporated there, and is then sucked into the compressor 10 through the first suction port 28a via the first vapor suction piping 36a. In a similar manner, the working medium delivered from the second delivery port 26b is routed through the second vapor delivery piping 30b, second condensation chamber 20b, second liquid piping 34b, second expansion device 32b, second evaporation chamber 24b, second vapor suction piping 36b, and second suction port 28b, and then is sucked into compressor 10. The working medium delivered from the third delivery port 26c is routed through the third vapor delivery piping 30c, third condensation chamber 20c, third liquid piping 34c, third expansion device 32c, third evaporation chamber 24c, third vapor suction piping 36c, and third suction port 28c, and then is sucked into compressor 10. The working medium delivered from the fourth delivery port 26d is routed through the fourth vapor delivery piping 30d, fourth condensation chamber 20d, fourth liquid piping 34d, fourth expansion device 32d, fourth evaporation chamber 24d, fourth vapor suction piping 36d, and fourth suction port 28d, and then is sucked into compressor 10.

Figure 4:
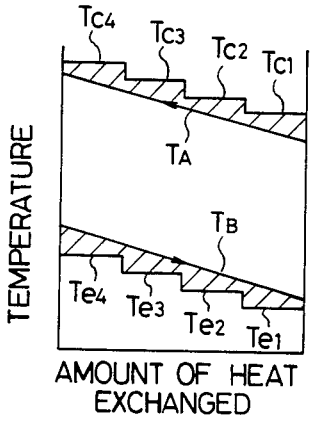
FIG. 4 is an explanatory diagram of operation for illustrating the temperature variations during the heat exchange in the heat pump system shown in FIG. 3.

In the above-described process, the pressures $P_{c1}$, $P_{c2}$, $P_{c3}$, and $P_{c4}$ in the first condensation chamber 20a through the fourth condensation chamber 20d, respectively, satisfy the relation $P_{c1}<P_{c2}<P_{c3}<P_{c4}$, and the pressures $P_{e1}$, $P_{e2}$, $P_{e3}$, and $P_{e4}$ in the first evaporation chamber 24a through the fourth evaporation chamber 24d, respectively, satisfy the relation $P_{e1}<P_{e2}<P_{e3}<P_{e4}$. Because of this, the temperature in the first condensation chamber 20a, represented by the segment $T_{c1}$ of FIG. 4, is lower than the temperature in the second condensation chamber 20b represented by the segment $T_{c2}$, which in turn is lower than the temperature in the third condensation chamber 20c represented by segment $T_{c3}$. Temperature $T_{c3}$ is lower than the temperature in the fourth condensation chamber 20d represented by the segment $T_{c4}$, indicating a stepwise increase in the temperature.

Further, the temperature in the first evaporation chamber 24a, represented by the segment $T_{e1}$ of FIG. 4, is lower than the temperature in the second evaporation chamber 24b represented by the segment $T_{e2}$, which in turn is lower than the temperature in the third evaporation chamber 24c represented by the segment $T_{e3}$. Temperature $T_{e3}$ is lower than the temperature in the fourth evaporation chamber 24d represented by the segment $T_{e4}$, indicating a stepwise increase in the temperature.

The high-temperature source fluid that flows from the side of the first condensation chamber 20a to the side of the fourth condensation chamber 20d in the condenser 12, as indicated by the arrows A (FIG. 3) undergoes temperature variation as represented by the segment $T_A$ of FIG. 4, and the temperatures of the working medium go upward stepwise along the temperature variation $T_A$ of the high-temperature source fluid. Therefore, the irreversible energy loss that occurs during the heat exhange between the two media, as indicated by the hatched portion of FIG. 4, can be restrained markedly in comparison to the case of the prior art system as shown by FIG. 1. Similarly, the low-temperature source fluid that flows from the fourth evaporation chamber 24d to the first evaporation chamber 24a in the evaporator 14, as indicated by the arrows B (FIG. 3), undergoes temperature variation as represented by the segment $T_B$ of FIG. 4. With respect to the temperature variation of the low temperature source fluid, the temperature of the working medium in the evaporator 14 goes down stepwise along the temperature variation $T_B$ of the low-temperature source fluid. Therefore, the irreversible energy loss during the heat exchange as indicated by the hatching in the figure is restrained markedly in comparison to the case of the prior art system of FIG. 1. Accordingly, the overall irreversible energy losses during the heat exchange are restrained markedly, improving the performance of the system conspicuously.

Figure 5:
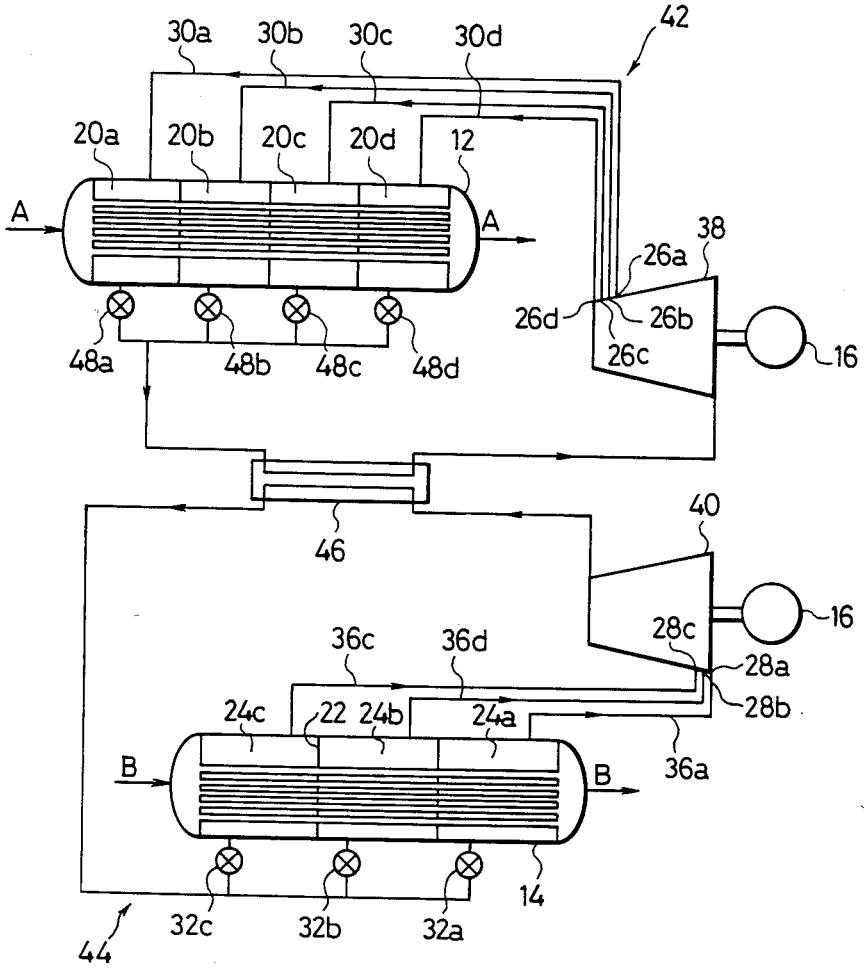
FIG. 5 is a block diagram for a second embodiment of the heat pump system in accordance with the present invention.

FIG. 5 relates to a second embodiment of the present invention which illustrates the case where the invention is applied to a cascaded heat pump system. A cascaded heat pump system is suitable for use in cases where a large range of temperature rise is required, such as in generating hot water over 150° C., or the like, by the use of industrial waste water as the low-temperature source fluid which has a temperature of from 30° C. to 60° C.

In this embodiment, the compressors consist of a high-temperature side compressor 38 and a low-temperature side compressor 40. A high-temperature cycle 42 is formed by the high-temperature side compressor 38 and the condenser 12, while a low-temperature cycle 44 is formed by the low-temperature side compressor 40 and the evaporator 14. The high-temperature cycle 42 and the low-temperature cycle 44 are coupled by a cascading heat exchanger 46. The reference numerals **48*a* through 48*d*** designate the first through the fourth expansion devices on the high-temperature side. Since the remaining components are, for purposes of the invention, identical to those of the first embodiment, they are given the same reference numerals to omit further explanation.

Figure 6:
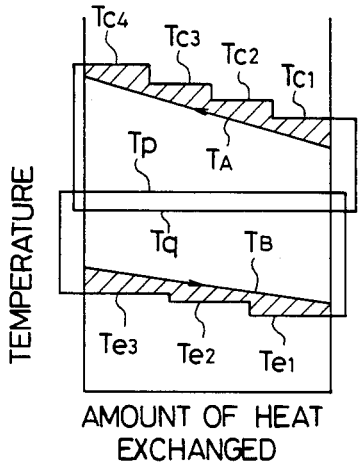
FIG. 6 is an explanatory diagram of operation for illustrating the temperature variations during the heat exchange in the heat pump system shown in FIG. 5.

The temperature in the first evaporation chamber **24*a* through the third evaporation chamber 24*c* go down stepwise from $T_{e3}$ to $T_{e1}$ as shown by the segments $T_{e1}$, $T_{e2}$, and $T_{e3}$ of FIG. 6, corresponding to the temperature decrease of the low temperature source fluid as shown by the segment $T_B$, achieving a reduction of the irreversible energy loss during the heat exchange. The temperature inside the cascading heat exchanger 46 on the side of the low-temperature cycle 44 is constant as indicated by the segment $T_p$, and the heat exchange is carried out at the temperature shown by the segment $T_p$ with respect to the working medium in the high-temperature cycle which is at the temperature shown by the segment $T_q$. In this case, too, the temperature in the first condensation chamber 20*a*** is arranged to go up stepwise along with the temperature rise in the high temperature source fluid, so that it is possible to reduce the irreversible energy loss during the heat exchange.

Figure 7:
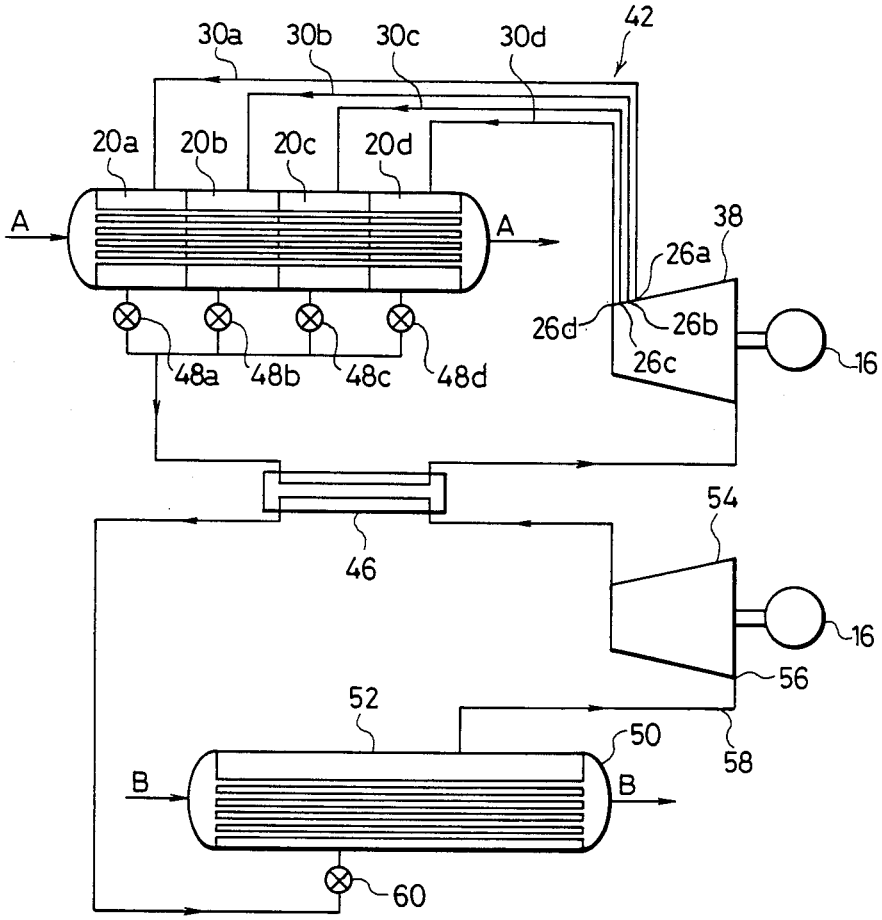
FIG. 7 is a block diagram for a third embodiment of the heat pump system in accordance with the present invention.

FIG. 7 relates to a third embodiment of the present invention which is actually a modification of the second embodiment. In this embodiment, the evaporator 50 is arranged to have a single evaporation chamber 52, and correspondingly there is given just one suction port 56 for the low-temperature side compressor 54, the evaporation chamber 52 and the suction port 56 being mutually connected by a vapor suction piping 58. Further, on the lowtemperature side there is installed an expansion device 60. Components of this embodiment similar to those described above are similarly designated. This embodiment is suited for the case in which there is available a large quantity of low-temperature source fluid such that the temperature lowering in the low-temperature source fluid can be minimized even when heat exchange takes place in the evaporator 50.

Figure 8:
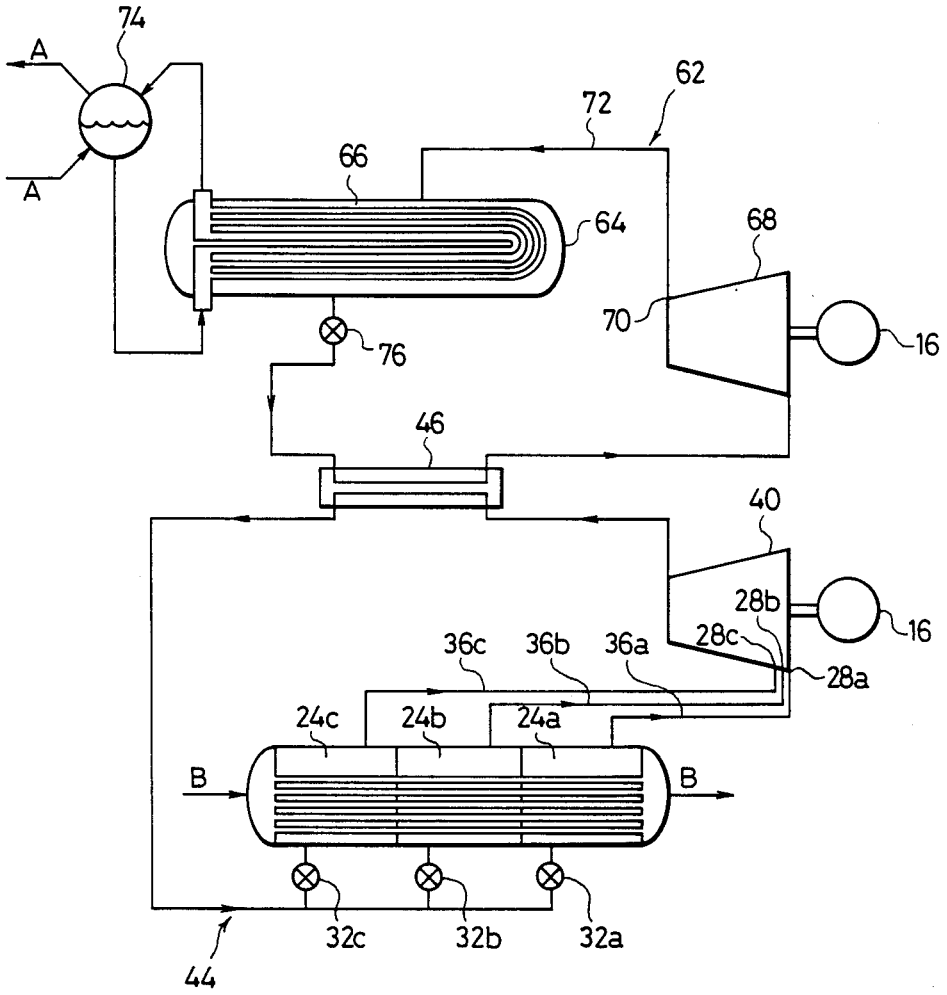
FIG. 8 is a block diagram for a fourth embodiment of the heat pump system in accordance with the present invention.

FIG. 8 concerns a fourth embodiment of the present invention, which represents another modification to the second embodiment. In this fourth embodiment, the condenser 64 in the high-temperature cycle 62 consists of a single condensation chamber 66. In addition, the high-temperature side compressor 68 has a single delivery port 70 which is connected to the condensation chamber 66 by a vapor delivery piping 72. The high-temperature source fluid circulates between a drum 74 and the condenser 64 to generate vapor in the condenser 64. Further, there is installed an expansion device 76 on the side of the high-temperature cycle 62. Again, like components are similarly designated. In this embodiment, the temperature of the high-temperature source fluid that is being heated does not vary, due to the accompanying evaporation, so that it is possible to give single construction for both of the delivery port 70 and the condensation chamber 66.

Figure 9:
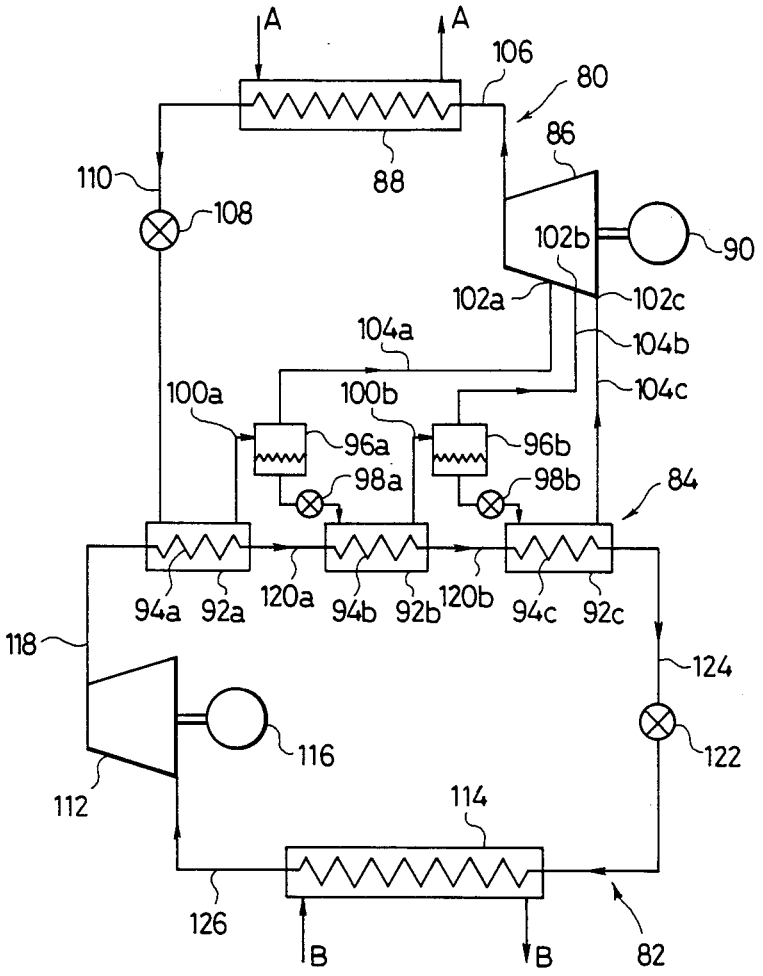
FIG. 9 is a simplified block diagram for a fifth embodiment of the heat pump system in accordance with the present invention.

Referring to FIG. 9, there is shown a fifth embodiment of the heat pump system in accordance with the present invention. The fifth embodiment is a cascaded heat pump system which is formed by coupling a high-temperature cycle 80 and a low-temperature cycle 82 by a cascading heat exchanger 84.

The high-temperature cycle 80 includes a high-temperature side compressor 86 and a condenser 88. The high-temperature side compressor 86 is arranged to be driven by a motor 90 to compress a single-component medium that is sealed in the interior of the high-temperature cycle, and the condenser 88 is arranged to condense the single-component medium.

The cascading heat exchanger 84 includes a plurality (three in FIG. 9) of heat exchange chambers that can operate independently of each other, namely, a first cascade evaporation chamber **92*a*, a second cascade evaporation chamber 92*b*, and a third cascade evaporation chamber 92*c*. In the interiors of the first cascade evaporation chamber 92*a* through the third cascade evaporation chamber 92*c* there are installed, respectively, a first cascade condensation section 94*a*, a second cascade condensation section 94*b*, and a third cascade condensation section 94*c*. The first cascade evaporation chamber 92*a* and the second cascade evaporation chamber 92*b* are connected by a first cascade piping 100*a* in which is inserted a first vapor-liquid separator 96*a* and a first cascade expansion device 98*a* that is connected to the liquid-phase side of the first vapor-liquid separator 96*a*. The second cascade evaporation chamber 92*b* and the third cascade evaporation chamber 92*c* are connected by a second cascade piping 100*b* in which is inserted a second vapor-liquid separator 96*b* and a second cascade expansion device 98*b* that is connected to the liquid-phase side of the second vapor-liquid separator 96*b***.

The suction side of the high-temperature side compressor 86 includes a plurality (three in FIG. 9) of suction ports, namely, a first suction port **102*a*, a second suction port 102*b*, and a third suction port 102*c*. The first suction port 102*a* through the third suction port 102*c* are respectively on different pressure levels which decrease successively from the first suction port 102*a* to the third suction port 102*c*, the third suction port 102*c* having the lowest pressure level. The first suction port 102*a* is connected via a first vapor suction piping 104*a* to the vapor-phase side of the first vapor-liquid separator 96*a*, the second suction port 102*b* is connected via a second vapor suction piping 104*b* to the vapor-phase side of the second vapor-liquid separator 96*b*, and the third suction port 102*c* is connected via a third vapor suction piping 104*c* to the third cascade evaporation chamber 92*c***, respectively.

The delivery side of the high-temperature side compressor 86 is connected via a high-temperature vapor delivery piping 106 to the condenser 88. The condenser 88 is connected to the first cascade evaporation chamber 92a of the cascading heat exchanger 84 via a high-temperature liquid piping 110 in which is inserted a high-temperature side expansion device 108.

The low-temperature cycle includes a low-temperature side compressor 112 and an evaporator 114. The low-temperature side compressor 112 is driven by a motor 116 and compresses a non-azeotropic mixture which is sealed in the interior of the low-temperature cycle as the working medium, and the evaporator 114 evaporates the non-azeotropic mixture.

The delivery side of the low-temperature side compressor 112 is connected via a low-temperature vapor delivery piping 118 to the first cascade condensation section 94a. The first cascade condensation section 94a and the second cascade condensation section 94b are connected by a first low-temperature cascade piping 120a, and the second cascade condensation section 94b and the third cascade condensation section 94c are connected by a second low-temperature cascade piping 120b. The third cascade condensation section 94c is connected to the evaporator 114 via a low-temperature liquid piping 124 in which is inserted a low-temperature side expansion device 122. The evaporator 114 is connected to the suction side of the low-temperature side compressor 112 via a low-temperature vapor suction piping 126.

Figure 10:
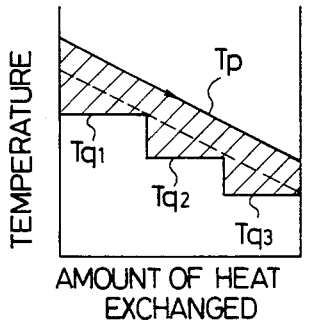
FIG. 10 is an explanatory diagram of operation for illustrating the temperature variations during the heat exchange in the heat pump system shown in FIG. 9.

Next, the operation of the fifth embodiment will be described. When the high-temperature side compressor 86 and the low-temperature side compressor 112 are driven by the motors 90 and 116, respectively, the non-azeotropic mixture in the low-temperature cycle, which acts as the working medium, is compressed and flows through in series the low-temperature vapor delivery piping 118, the first cascade condensation section 94a, the first low-temperature cascade piping 120a, the second cascade condensation section 94b, the second low-temperature cascade piping 120b, the third cascade condensation section 94c, and the low-temperature liquid piping 124. Then, it is evaporated in the evaporator 114, and is sucked again into the low-temperature side compressor 112 through the low-temperature vapor suction piping 126. In the evaporator 114, the low-temperature source fluid is arranged to flow in the counter-current direction with respect to the flow direction of the non-azeotropic mixture. In this case, the low-temperature source fluid decreases its temperature in the direction of its flow during heat exchange in the evaporator 114, while the non-azeotropic mixture increases its temperature in the flow direction due to the difference in the boiling points of the single-component media that comprise the mixture. Because of this, it becomes possible to reduce the temperature difference between the non-azeotropic mixture and the low temperature source fluid during the heat exchange in the evaporator 114, reducing the irreversible energy loss. At the same time, the non-azeotropic mixture undergoes temperature variations also in the condensation process in the cascading heat exchanger. In this case, the temperature of the non-azeotropic mixture varies from the first cascade condensation section 94a to the third cascade condensation section 94c, as shown by the segment $T_p$ of FIG. 10.

In the high-temperature cycle 80, the single-component medium that acts as the working medium is compressed by the high-temperature side compressor 86, flows through in series the high-temperature vapor delivery piping 106, the condenser 88, and the high-temperature liquid piping 110, and then flows into the first cascade evaporation chamber 92a of the cascading heat exchanger 84 after it has been expanded in the high-temperature side expansion device 108. A part of the single-component medium that has flowed in the first cascade evaporation chamber 92a is evaporated, and flows into the first vapor-liquid separator 96a via the first high-temperature cascade piping 100a. At the first vapor-liquid separator 96a, the medium is separated into vapor and liquid phases, and the vapor phase is sucked into the high-temperature side compressor 86 via the high-temperature vapor suction piping 104a and the first suction port 102a which is on the highest pressure level.

The liquid phase that was separated out in the first vapor-liquid separator 96a is expanded at the first cascade expansion device 98a, and flows in the second cascade evaporation chamber 92b. At the second cascade evaporation chamber 92b, similar to the case in the first cascade evaporation chamber 92a, a portion of the single-component medium is evaporated, and flows, via the second high-temperature cascade piping 100b, into the second vapor-liquid separator 96b. At the second vapor-liquid separator 96b, similar to the case in the first vapor-liquid separator 96a, separation into vapor and liquid is carried out, and the vapor phase separated is sucked, via the second high-temperature vapor suction piping 104b, into the high-temperature side compressor 86 from the second suction port 102b which is on the next higher pressure level.

The liquid phase that was separated out at the second vapor-liquid separator 96b is expanded at the second cascade expansion device 98b, and then flows into the third cascade evaporation chamber 92c. At the third cascade evaporation chamber 92c, the entirety of the single-component medium flowing in is evaporated, and is sucked, via the third high-temperature vapor suction piping 104c, into the high-temperature side compressor 86 through the third suction port 102c which is on the lowest pressure level. Therefore, the pressures $P_{q1}$, $P_{q2}$, and $P_{q3}$ in the first cascade evaporation chamber 92a, the second cascade evaporation chamber 92b, and the third cascade evaporation chamber 92c, respectively, satisfy the relation $P_{q1} > P_{q2} > P_{q3}$. Because of this, the temperature in the first cascade evaporation chamber 92a is highest as shown by the segment $T_{q1}$ of FIG. 10, the temperature in the second cascade evaporation chamber 92b is next highest as represented by the segment $T_{q2}$, and the temperature in the third cascade evaporation chamber 92c, represented by the segment $T_{q3}$, is lowest, showing a stepwise decrease in the temperature.

Accordingly, during heat exchange in the cascading heat exchanger 84, it becomes possible to minimize the difference between the temperature of the single-component medium on the side of the high-temperature cycle 80 and the temperature of the non-azeotropic mixture on the side of the low-temperature cycle 82, thus reducing irreversible energy loss. As a result, it becomes possible to achieve an improvement in the performance of the system by fully exploiting the characteristic features of the non-azeotropic mixture used in the low-temperature cycle 82.

The high-temperature source fluid that flows through the condenser 88 of the high-temperature cycle 80, as shown by the arrows A, is arranged to be circulated between the interior of, for example, a drum (not shown), to generate vapor in the condenser 88. Therefore, little change in the temperature of the high-temperature source fluid will occur during heat exchange in the condenser 88.

Figure 11:
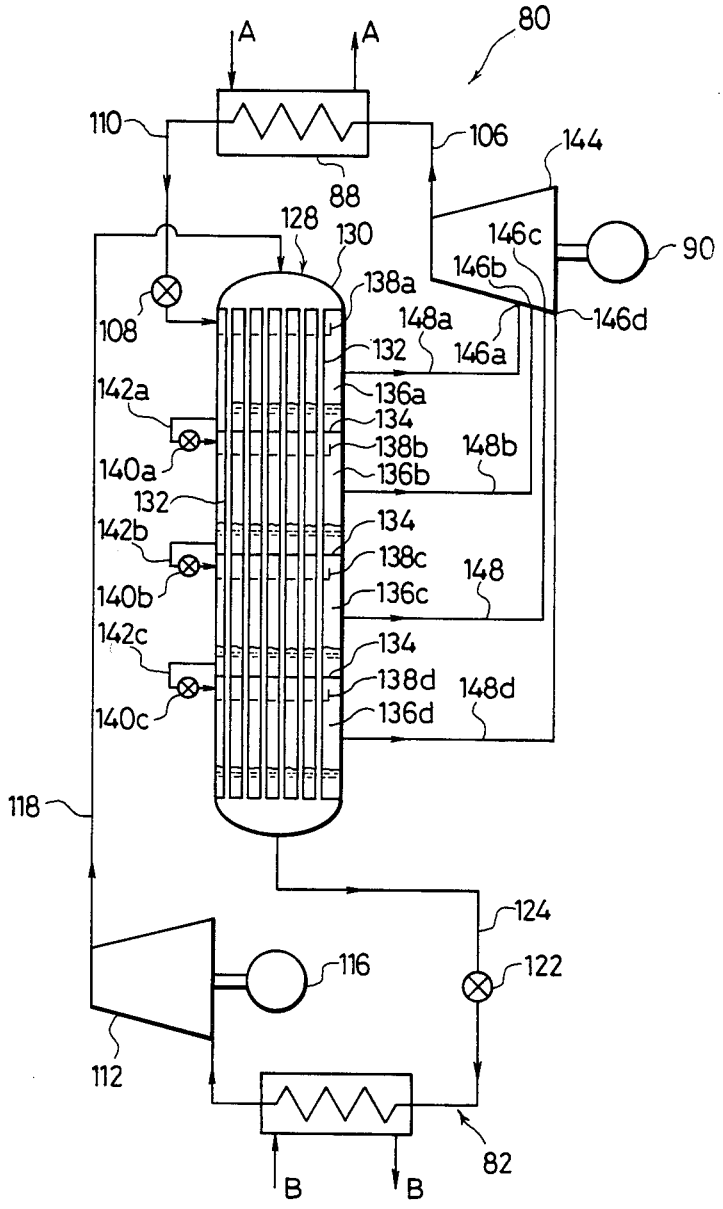
FIG. 11 is a block diagram for a sixth embodiment of the heat pump system in accordance with the present invention.

FIG. 11 concerns a sixth embodiment of the present invention, in which a cascading heat exchanger 128 serves also as a vapor-liquid separator. Specifically, the cascading heat exchanger 128 is equipped with a plurality of heat transfer tubes 132 that run in the vertical direction within a shell 130, and around the heat transfer tubes 132 there are formed a plurality (four in FIG. 11) of heat exchange chambers, a first cascade evaporation chamber 136*a* through a fourth cascade evaporation chamber 136*d*, by dividing the space with a plurality (three in FIG. 11) of partitioning plates 134. At an upper interior portion of each of the first cascade evaporation chamber 136*a* through the fourth cascade evaporation chamber 136*d*, there are installed respectively a first liquid distribution plate 138*a* through a fourth liquid distribution plate 138*d*, and between these liquid distribution plates 138*a* to 138*d* and each of the heat transfer tubes 132 there are formed openings through which the liquid can flow down along the heat transfer tubes 132. The high-temperature liquid piping 110 is connected to the space above the first liquid distribution plate 138*a* which is placed in the first cascade evaporation chamber 136*a*. The side of the partitioning plate 134 of the interior of the first cascade evaporation chamber 136*a* is connected, via a first cascade piping 142*a* in which is inserted a first cascade expansion device 140*a*, to the space above the second liquid distribution plate 138*b* within the second cascade evaporation chamber 136*b*. The side of the partitioning plate 134 of the interior of the second cascade evaporation chamber 163*b* is connected, via a second cascade piping 142*b* in which is inserted a second cascade expansion device 140*b*, to the space above the third liquid distribution plate 138*c* in the third cascade evaporation chamber 136*c*. The side of the partitioning plate 134 of the interior of the third cascade evaporation chamber 136*c* is connected, via a third cascade piping 142*c* in which is inserted a third cascade expansion device 140*c*, to the space above the fourth liquid distribution plate 138*d* within the fourth cascade evaporation chamber 136*d*.

A high-temperature side compressor 144 includes a plurality (four in FIG. 11) of suction ports that are on different pressure levels, namely, a first suction port 146*a* through a fourth suction port 146*d*. The first cascade evaporation chamber 136*a* is connected via a first vapor suction piping 148*a* to the first suction port 146*a*, the second cascade evaporation chamber 136*b* is connected via a second vapor suction piping 148*b* to the second suction port 146*b*, the third cascade evaporation chamber 136*c* is connected via a third vapor suction piping 148*c* to the third suction port 146*c*, and the fourth cascade evaporation chamber 136*d* is connected via a fourth vapor suction piping 148*d* to the fourth suction port 146*d*. The remaining components are similar to those of the fifth embodiment and are similarly designated.

In this embodiment, the single-component medium expanded in the high-temperature side expansion device 108 flows onto the first liquid distribution plate 138*a* in the first cascade evaporation chamber 136*a*, and is separated into vapor and liquid over the first liquid distribution plate 138*a*. Following that, the liquid phase of the single-component medium flows down along each of the heat transfer tubes 132 through the opening between the first liquid distribution plate 138*a* and each of the heat transfer tubes 132, a portion of the liquid being evaporated as it flows down. This evaporated portion forms a vapor phase, which, along with the vapor phase generated by the process of separation of vapor and liquid, is sucked into the high-temperature side compressor 144 through the first suction port 146*a* that is on the highest pressure level, via the first vapor suction piping 148*a*. The liquid phase in the first cascade evaporation chamber 136*a* flows through the first cascade piping 142 and is expanded at the first cascade expansion device 140*a*, and the liquid phase in the second cascade evaporation chamber 136*b* which remains unevaporated flows onto the second liquid distribution plate 138*b*. By an action similar to that described above, the vapor phase in the second cascade evaporation chamber 136*b* is sucked into the high-temperature side compressor 144 through the second suction port 146*b* which is on the next highest pressure level, via the second vapor suction piping 148*b*. The liquid phase in the second cascade evaporation chamber 136*b* flows through the second cascade piping 142*b*, is expanded at the second cascade expansion device 140*b*, and flows onto the third liquid distribution plate 138*c* in the third cascade evaporation chamber 136*c*. The vapor phase in the third cascade evaporation chamber 136*c* is sucked into the high-temperature side compressor 144 from the third suction port 146*c* which is on the next higher pressure level, via the third vapor suction piping 148*c*. The liquid phase in the third cascade evaporation chamber 136*c* flows through the third cascade piping 142*c*, is expanded at the third cascade expansion device 140*c*, and flows onto the fourth liquid distribution plate 138*d* in the fourth cascade evaporation chamber 136*d*. In the fourth cascade evaporation chamber 136*d*, the entirety of the unevaporated liquid is evaporated and is sucked into the high-temperature side compressor 144 from the fourth suction port 146*d* which is on the lowest pressure level, via the fourth vapor suction piping 148*d*. Therefore, the pressures $P_{q1}$, $P_{q2}$, $P_{q3}$, and $P_{q4}$ in the first cascade evaporation chamber 136*a*, the second cascade evaporation chamber 136*b*, the third cascade evaporation chamber 136*c*, and the fourth cascade evaporation chamber 136*d*, respectively, satisfy the relation $P_{q1} > P_{q2} > P_{q3} > P_{q4}$.

Figure 12:
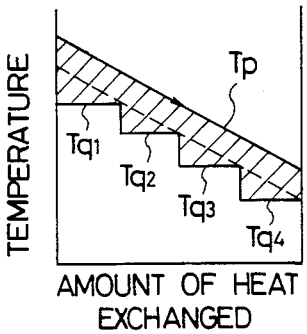
FIG. 12 is an explanatory diagram of operation for illustrating the temperature variations during the heat exchange in the heat pump system as shown in FIG. 11.

Because of this, the temperature in the first cascade evaporation chamber 136*a* is highest as shown by the segment $T_{q1}$ of FIG. 12, the temperature in the second cascade evaporation chamber 136*b*, represented by the segment $T_{q2}$ is second highest, the temperature in the third cascade evaporation chamber 136*c*, represented by the segment $T_{q3}$ is third highest, and the temperature in the fourth cascade evaporation chamber 136*d*, represented by the segment $T_{q4}$ is the lowest, showing a stepwise decrease in the temperature. Accordingly, as in the case for the fifth embodiment, the irreversible energy loss during the heat exchange in the cascading heat exchanger 128 can be reduced.

Figure 13:
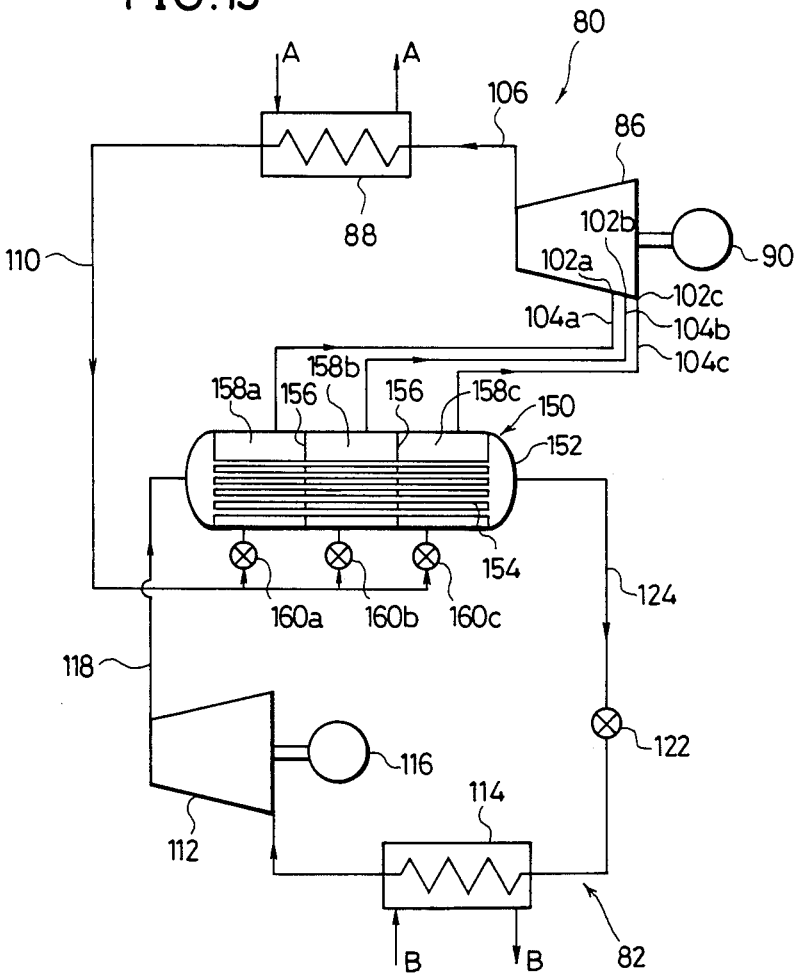
FIG. 13 is a block diagram for a seventh embodiment of the heat pump system in accordance with the present invention.

FIG. 13 concerns a seventh embodiment of the present invention in which a cascading heat exchanger 150 has heat transfer tubes 154 in a shell 152. A first cascade evaporation chamber 158*a* through a third cascade evaporation chamber 158*c* are formed by dividing the interior of the shell 152 by the partitioning plates 156. The first cascade evaporation chamber 158*a* through the third cascade evaporation chamber 158*c* are connected to the first suction port 102*a* through the third suction port 102*c*, respectively, of the high-temperature side compressor 86. Further, one end of the high-temperature liquid piping 110 whose other end is connected to the condenser 88 is connected, via a first high-temperature side expansion device 160*a* through a third high-temperature side expansion device 160*c*, to the first cascade evaporation chamber 158*a* through the third cascade evaporation chamber 158*c*, respectively. The remaining components are similar to those in the first embodiment and are similarly designated.

Figure 14:
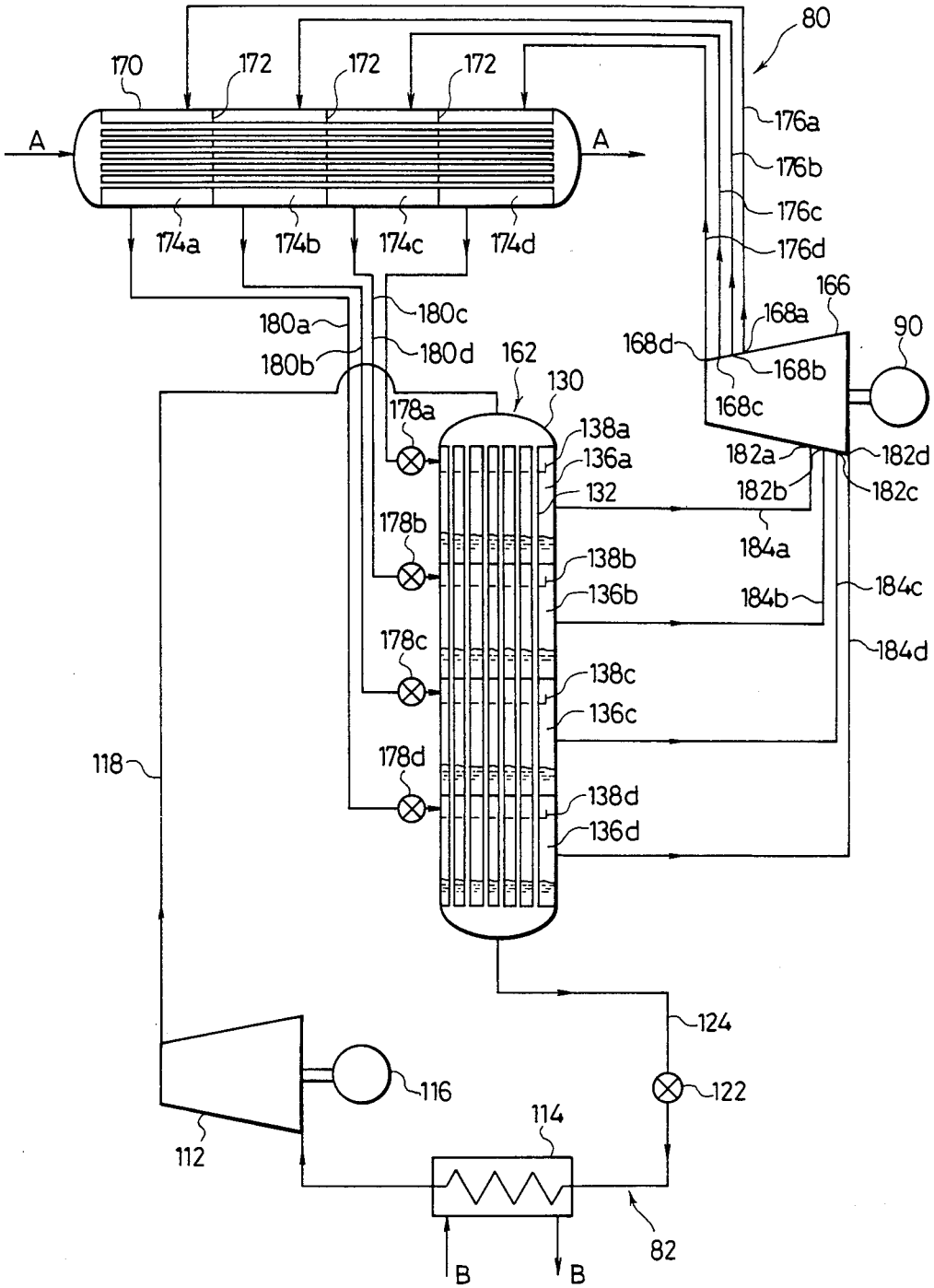
FIG. 14 is a block diagram for an eighth embodiment of the heat pump system in accordance with the present invention.

FIG. 14 concerns an eighth embodiment of the present invention in which the construction of a cascading heat exchanger 162 is similar to the heat exchanger in the sixth embodiment (FIG. 11), with an exception that the cascading heat exchanger 162 of this embodiment lacks the first cascade piping 142*a* through the third cascade piping 142*c* and the first cascade expansion device 140*a* through the third cascade expansion device 140*c* of the sixth embodiment. On the delivery side of a high-temperature side compressor 166 there is installed a plurality (four in FIG. 14) of delivery ports, namely, a first delivery port 168*a* through a fourth delivery port 168*d*. A condenser 170 includes a plurality (four in FIG. 14) of compartments, a first condensation chamber 174*a* through a fourth condensation chamber 174*d*, that are divided by partitioning plates 172. The first condensation chamber 174*a* through the fourth condensation chamber 174*d* are connected to the first delivery port 168*a* through the fourth delivery port 168*d* via a first vapor delivery piping 176*a* through a fourth vapor delivery piping 176*d*, respectively. Further, the first condensation chamber 174*a* through the fourth condensation chamber 174*d* are connected to the first cascade evaporation chamber 136*a* through the fourth cascade evaporation chamber 136*d*, via a first high-temperature liquid piping 180*a* through a fourth high-temperature liquid piping 180*d* in which are inserted a first high-temperature side expansion device 178*a* through a fourth high-temperature side expansion device 178*d*, respectively. Moreover, the suction side of the high-temperature side compressor 166 includes a plurality (four in FIG. 14) of suction ports that are on different pressure levels, namely, a first suction port 182*a* through a fourth suction port 182*d*. The first suction port 182*a* through the fourth suction port 182*d* are connected to the first cascade evaporation chamber 136*a* through the fourth cascade evaporation chamber 136*d* of the cascading heat exchanger 162, via a first high-temperature vapor suction piping 184*a* through a fourth high-temperature vapor suction piping 184*d*, respectively. The remaining components are similar to those in the sixth embodiment and are similarly designated.

Figure 15:
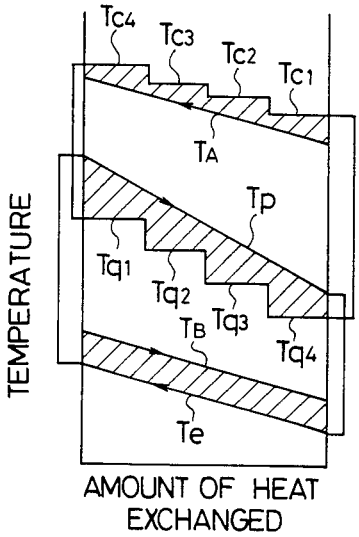
FIG. 15 is an explanatory diagram of operation for illustrating the temperature variations during the heat exchange in a heat pump system as shown in FIG. 14.

In addition, in this embodiment, the pressures $P_{c1}$, $P_{c2}$, $P_{c3}$, and $P_{c4}$ in the first condensation chamber 174*a*, the second condensation chamber 174*b*, the third condensation chamber 174*c*, and the fourth condensation chamber 174*d*, respectively, satisfy the relation $P_{c1}<P_{c2}<P_{c3}<P_{c4}$. Accordingly, the temperature in the first condensation chamber 174*a* through the fourth condensation chamber 174*d* increases stepwise as shown by the segments $T_{c1}$ through $T_{c4}$ of FIG. 15, making it possible for the temperature in the condensation chambers to correspond to the rise in the temperature of the high-temperature source fluid $T_A$ during the heat exchange in the condenser 170. Because of this, the difference between the two temperatures decreases so that it becomes possible to achieve a reduction of the irreversible energy losses during the heat exchange. Further, the single-component working medium that is expanded in the first high-temperature side expansion device 178*a* through the fourth high-temperature side expansion device 178*d* is introduced separately into the first cascade evaporation chamber 136*a* through the fourth cascade evaporation chamber 136*d*. In the first cascade evaporation chamber 136*a* through the fourth cascade evaporation chamber 136*d*, the medium that is introduced is evaporated separately. The evaporated vapor is sucked from the first cascade evaporation chamber 136*a* into the high-temperature side compressor 166 through the first suction port 182*a* which is on the highest pressure level, via the first high-temperature vapor suction piping 184*a*. Also, the vapor is sucked, from the second cascade evaporation chamber 136*b*, via the second high-temperature evaporation suction piping 184*b*, through the second suction port 182*b* which is on the next highest pressure level, from the third cascade evaporation chamber 136*c*, via the third high-temperature vapor suction piping 184*c*, through the third suction port 182*c* which is on the next highest pressure level, and from the fourth cascade evaporation chamber 136*d*, via the fourth high-temperature vapor suction piping 184*d*, through the fourth suction port 182*d* which is on the lowest pressure level, respectively, to the high-temperature side compressor 166.

Accordingly, the pressures $P_{q1}$, $P_{q2}$, $P_{q3}$, and $P_{q4}$ in the first cascade evaporation chamber 136*a* through the fourth cascade evaporation chamber 136*d* satisfy the relation $P_{q1}>P_{q2}>P_{q3}>P_{q4}$. Because of this, the temperature in the first cascade evaporation chamber 136*a* through the fourth cascade evaporation chamber 136*d* decrease stepwise as represented by the segments $T_{q1}$ through $T_{q4}$ of FIG. 15, restraining the irreversible energy loss during the heat exchange. Therefore, even when the high-temperature source fluid undergoes temperature variations due to heat exchange, it is possible in this embodiment to achieve an improvement of performance for the system.

Figure 16:
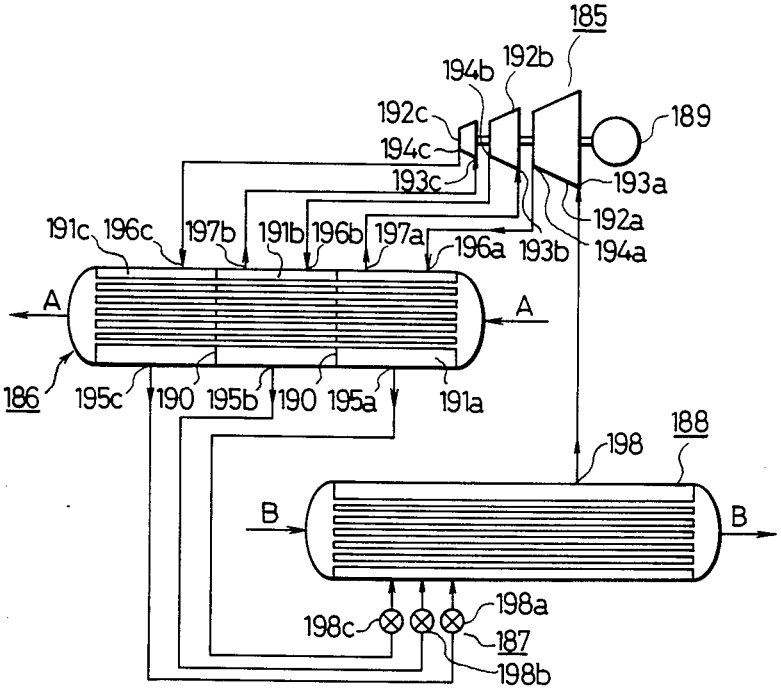
FIG. 16 is a block diagram for a ninth embodiment of the heat pump system in accordance with the present invention.

Referring to FIG. 16, there is illustrated a ninth embodiment of the heat pump system in accordance with the present invention. The heat pump system in this embodiment includes a compressor 185, a condenser 186, an expansion device 187, and an evaporator 188. The compressor 185, which is driven by a motor 189, compresses the working medium sealed in the interior, the condenser 186 condenses the vapor that was compressed in the compressor 185, the expansion device 187 expands the condensed liquid to a low pressure, and the evaporator 188 evaporates the working medium. The interior of the condenser 186 is divided by a plurality (two in FIG. 16) of partitioning plates 190, creating a plurality (three in FIG. 16) of condensation chambers, namely, a first condensation chamber 191*a*, a second condensation chamber 191*b*, and a third condensation chamber 191*c*. The first condensation chamber 191*a* through the third condensation chamber 191*c* are arranged in the direction of flow of the high-temperature source fluid (A).

Similarly, the compressor 185 is divided into a plurality (three in FIG. 16) of stages, namely, a first stage compressor 192*a*, a second stage compressor 192*b*, and a third stage compressor 192*c*, and the respective stages include corresponding suction ports 193*a*, 193*b*, and 193*c* and delivery ports 194*a*, 194*b*, and 194*c*.

Furthermore, each of the condensation chambers 191*a*, 191*b*, and 191*c* of the condenser 186 includes, in addition to the respective condensed fluid outlets 195*a*, 195*b*, and 195*c* and the vapor inlets 196*a*, 196*b*, and 196*c*, respective vapor extraction ports 197*a* and 197*b* except for the last condensation chamber (third condensation chamber 191c in FIG. 16). An evaporated vapor outlet 198 which is installed on the evaporator 188 is connected to the suction port 193a of the first stage compressor, the delivery port 194a of the first stage compressor is con-nected to the vapor inlet 196a of the first condensation chamber, the vapor extraction port 197a of the first condensation chamber is connected to the suction port 193b of the second stage compressor, the delivery port 194b of the second stage compressor is connected to the vapor inlet 196b of the second condensation chamber, the vapor extraction port 197b of the second condensation chamber is connected to the suction port 193c of the third stage compressor, and the delivery port 194c of the third compressor is connected to the vapor inlet 196c of the third condensation chamber, respectively.

The condensed liquid outlets 195a, 195b, and 195c are connected to the evaporator 188 via the expansion devices 198a, 198b, and 198c, respectively. In the evaporator 188 there flows a low temperature source fluid (B).

Next, the operation of the above embodiment will be described. The vapor of the working medium that was evaporated in the evaporator 188 by the heat from the low-temperature source fluid (B) is compressed in the first stage compressor 192a, and flows in the first condensation chamber 191a where it is condensed. At the same time, a portion of the vapor is sucked into the second stage compressor 192b through the vapor extraction port 197a, where it is recompressed, and then flows into the second condensation chamber 191b. Here, too, a portion of the vapor is sucked into the third stage compressor 192c through the vapor extraction port 197b, and after it is recompressed there, it flows in the third condensation chamber 191c where it is completely condensed. The liquid condensed in each of the condensation chambers 191a, 191b, and 191c flows into the evaporator 188 via the expansion devices 198a, 198b, and 198c, respectively.

Figure 17:
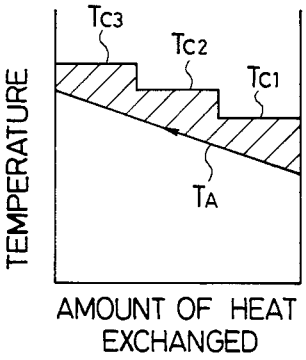
FIG. 17 is an explanatory diagram of operation for illustrating the temperature variations during the heat exchange in the heat pump system as shown in FIG. 16.

As may be clear from the foregoing description, the pressure $P_{c1}$, $P_{c2}$, and $P_{c3}$ in the condensation chambers 191a, 191b, and 191c, respectively, increase successively as shown by $P_{c1}<P_{c2}<P_{c3}$. Because of this, the temperature in each of the condensation chambers increases successively, as is represented by the segments ($T_{c1}$, $T_{c2}$, $T_{c3}$) of FIG. 17. On the other hand, the high-temperature source fluid that flows as indicated by the arrows A from the side of the first condensation chamber 191a to the side of the third condensation chamber 191c in the condenser 186, undergoes temperature variation as shown by the segment $T_A$ of FIG. 17. The temperature of the working medium increases stepwise along the temperature variation $T_A$ of the high-temperature source fluid. Therefore, the irreversible energy loss that occurs during the heat exchange between the two media, as shown by the hatched portion of FIG. 17, can be reduced markedly compared with the case of the prior art device illustrated by FIG. 1.

Figure 18:
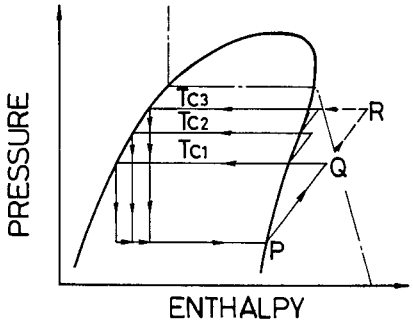
FIG. 18 is the Mollier chart for the heat pump system as shown in FIG. 16.

The present invention possesses one effect which will now be described based on FIG. 18. FIG. 18 is a Mollier chart (pressure/enthalpy chart) showing the cycle which is characterized by FIG. 16. If a condensation temperature $T_{c3}$ is obtained from the vapor that is sucked from the evaporator (represented by the point P in FIG. 18) under a single stage of compression, in most cases of generally utilized refrigerants, there is obtained at the outlet of the compressor a superheated vapor (represented by the point R in FIG. 18), bringing about reductions in the efficiency and the life of the refrigerant, lubrication oil and the compressor. However, according to the present invention, the vapor is introduced into the first condensation chamber after it is compressed by the first stage compressor up to the pressure corresponding to the condensation temperature $T_{c1}$ (the point Q in FIG. 18), and it is arranged to be sucked into the second stage compressor after it has been saturated in the first condensation chamber. Therefore, it is possible to lower the highest temperature in the compressor markedly compared with the case of a single stage of compression.

On the contrary, for a medium which becomes wet in the compression process, the compressor at each stage sucks in a saturated vapor, so that it becomes possible to realize an effect in which the degree of wetness of the medium at the outlet of the compressor can be lowered markedly compared with the case of a single stage of compression.

Moreover, the present invention is not limited to the embodiments described in the foregoing. Thus, for example, the interior of the condensation chamber or the evaporation chamber under identical pressure level may further be divided into a plurality of compartments. Further, the plurality of condensation chambers or evaporation chambers need not be limited to those that are created by means of partitioning plates, but can take the form of a plurality of independently operating condensers or evaporators.

Furthermore, the compressors need not be limited to the coaxial type that are driven by a single motor, but may be replaced by a combination of a plurality of independently operating compressors. Finally, it should be noted that the present invention may be applied to refrigerators.

The foregoing description of preferred embodiments has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A heat pump system for obtaining a high temperature source fluid by making use of a low temperature source fluid, comprising:

a first compressor having suction and delivery sides for compressing and delivering a first working medium, said first compressor including at least on said suction side a plurality of suction ports which are on different pressure levels;

condensation means for condensing the first working medium from said first compressor in order to supply heat to the high temperature source fluid:

a second compressor having suction and delivery sides for compressing and delivering a second working medium;

evaporation means for evaporating the second working medium in order to extract heat from the low temperature source fluid; and a cascading heat exchange means for exchanging heat between the first working medium from said condensation means and the second working medium from said second compressor, said cascading heat exchange means comprising a plurality of heat exchangers and/or heat exchange chambers, the plurality of heat exchangers and/or heat exchange chambers and the suction ports of said first compressor being connected respectively, and the second working medium serially flowing through the plurality of heat exchangers and/or heat exchange chambers;

wherein the first working medium is a single component medium, and the second working medium is a non-azeotropic mixture.

2. A heat pump system as claimed in claim 1, wherein said first compressor is a high-temperature compressor, and said second compressor is a low-temperature compressor.

3. A heat pump system as claimed in claim 2, wherein a high-temperature cycle is formed by said high-temperature compressor and said condenser, and a low-temperature cycle is formed by said low temperature compressor and said evaporator.

* * * * *